United States Patent [19]

Webb

[11] 4,297,529

[45] Oct. 27, 1981

[54] MODULAR TELEPHONE JACK

[75] Inventor: Gerald F. Webb, Thorndale, Canada

[73] Assignee: Northern Telecom Limited, Montreal, Canada

[21] Appl. No.: 89,224

[22] Filed: Oct. 29, 1979

[51] Int. Cl.[3] ..... H01R 13/40; H01R 13/62

[52] U.S. Cl. ..... 179/1 PC; 339/176 M; 339/218 M

[58] Field of Search ..... 179/1 PC, 1 C, 2 C; 339/17 LC, 99 R, 176 M, 218 R, 218 M

[56] References Cited

U.S. PATENT DOCUMENTS

| | | | |
|---|---|---|---|
| T961,003 | 8/1977 | Krumreich | 179/1 PC |
| 3,850,497 | 11/1974 | Krumreich et al. | 339/176 M |
| 3,990,764 | 11/1976 | Krumreich | 339/176 M |
| 4,070,548 | 1/1978 | Kasper | 179/1 PC |
| 4,202,593 | 5/1980 | Abernethy et al. | 339/176 M |
| 4,231,628 | 11/1980 | Hughes et al. | 339/218 M |

*Primary Examiner*—Bernard Konick
*Assistant Examiner*—Randall P. Myers
*Attorney, Agent, or Firm*—Sidney T. Jelly

[57] ABSTRACT

A modular telephone jack has a plurality of cantilever spring wire contact members extending down from a top part into an aperture which receives a modular plug. Instead of being positioned in holes extending through the top part, being then bent down and then back, the contact members are molded in at one end into the top part. This avoids bending of the wire, with possible cracking of corrosion preventive plating and also reduces the amount of wire. As an additional feature the jack may be of two parts, slid together and held together at front end by interengaging formations, with one or more resilient members engaged in detents at the rear ends.

5 Claims, 13 Drawing Figures

MODULAR TELEPHONE JACK

This invention relates to a modular telephone jack and is particularly concerned with the provision of a jack in which wire contact members are molded in to a part of the jack.

Conventional jacks for use with modular plugs, have a plurality of cantilever spring wire contact members. These members each have a first part which extends into a bore in the jack, an intermediate part which extends down an end face and a further part which extends back from the end face and inclined away from the jack part. The inclined parts make contact with contact members in a plug. Flexible conductors are connected to the wire contact members, the connection between conductor and wire contact member usually being positioned in the bore. Each wire contact member has two bends and the wire is also gold plated for corrosion resistance and good contact characteristics. By molding in the wires it is possible to make the wire contact members considerably shorter, reducing plating costs, and also avoids two bends, which often result in cracking of the gold plate.

In its broadest concept, the present invention provides a modular telephone jack in which the cantilever spring wire contact members are molded into the jack and extend therefrom.

In a further feature of the invention, the jack is composed of two parts, one of which carries the cantilever spring wire contact members and slidably assembles to another part to form a complete jack, with at least one resilient deflectable member on the other part of the jack engaging with a detent in the one part to hold the one part in an assembled position.

The invention will be readily understood by the following description of certain embodiments, by way of example, in conjunction with the accompanying drawings, in which.

The present invention has two features, the first being the molding in of the cantilever spring wire contact members. Jacks may be molded in one piece but generally, for ease of manufacture, a jack comprises two main parts, one which holds the cantilever spring wire contact members, hereinafter referred to as the wire contact members and the other part which has a profiled slot which, in combination with the one part defines a profiled aperture for reception and retention of a plug. Conveniently, hereinafter, the part holding the wire contact members is referred to as the top part and the other part is referred to as the bottom part, although the mounting position of the jack may affect this in actual use.

Figure 1:
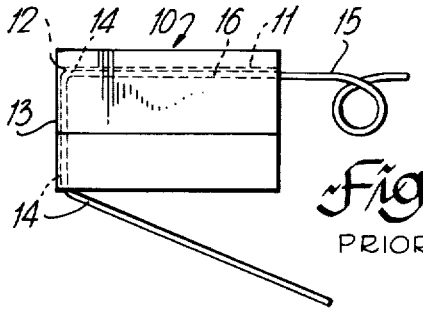
Fig. 1 PRIOR ART
FIG. 1 is a side view of a part of a conventional jack, illustrating the positioning of cantilever spring wire contact members.
Figure 3:
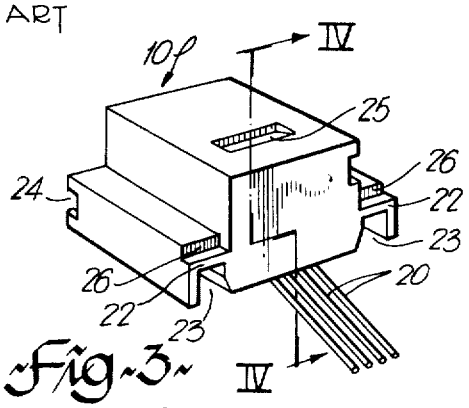
FIG. 3 is an end view in the direction of arrow A in FIG. 2.

FIG. 1 illustrates a conventional form of a top part of a jack. It comprises a molded plastic body 10 having a plurality of bores 11 therethrough. From one end of the bores 11, grooves 12 extend down the end face 13. Wire contact members 14 extend in the bores 11, down the grooves 12 and then back along under the top part, being inclined away from the body 10 to form cantilever spring contact portions. Flexible conductors 15 are connected to the wire contact members 14, the connection usually being contained in the bores 11, for example at 16. This form of assembly is described and illustrated for example, in U.S. Pat. No. 3,850,497.

To prevent corrosion and to ensure good electrical contact between the wire contact members and contact members in a mating plug, the wire contact members are gold plated. The wire contact members are plated before attachment of the flexible conductors 15. The wire contact members are then assembled to the body 10 by insertion into the bores 11 followed by bending down into the grooves 12 and a further bending back under the body 10. There is quite an appreciable length of the wire contact members which is gold plated. Further, the bending, at 17 of FIG. 1, often cracks the gold plate, allowing corrosion. This corrosion can cause a poor quality electrical connection to occur between adjacent wire contact members, causing noise on the telephone line.

FIGS. 2, 3, 4 and 5 illustrate a top part as provided by the present invention. The top part has a body 10 of molded plastic but wire contact members 20 are molded into the body 10 at one end 21. The wire contact members are molded in to give the desired initial inclination, as can be seen in the cross-section of FIG. 4, to give the required contact forces. It will be seen that there is considerably less length of wire used, and thus plated, and bends are avoided. The wire contact members are produced from a roll in automatic cutting machines and if desired one end of the length of wire can be roughened for improving bonding between wire and body. However this may require correct orientation of the lengths of wire prior to insertion in the mold, or roughening of both ends, depending on whether the free ends curve in contact with contact members in a mating plug. Further, it is not essential that the full length of each wire be plated, only that portion in contact with the contact members of a plug. Other common resistant, low contact resistance plating can be used e.g. silver.

The particular embodiment illustrated in FIGS. 2 to 5 is intended to be formed, that is molded, as a separate part, a top part, for assembly to a bottom part. To this end, the body 10 has two lateral extensions 22, one at each side, each extension having a longitudinal groove 23 in its lower surface. The grooves receive complimentary ribs on the bottom part and the two parts can be permanently bonded together, as by sonic welding.

Figure 2:
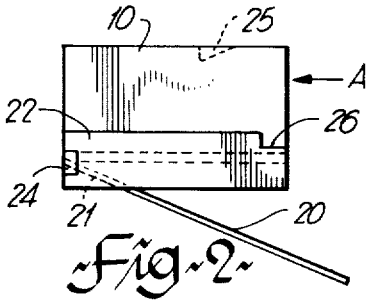
FIG. 2 is a side view of a part of a jack in accordance with the present invention.
Figure 4:
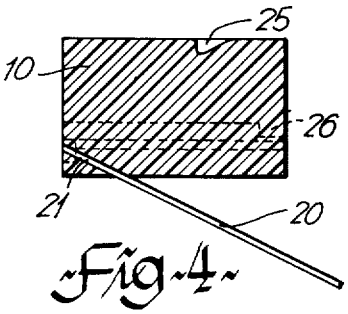
FIG. 4 is a cross-section on the line IV—IV of FIG. 3.
Figure 5:
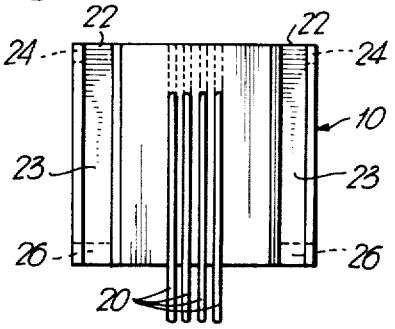
FIG. 5 is a bottom plan view of the part illustrated in FIGS. 2, 3 and 4.

A further feature of the present invention, also illustrated in the embodiment of FIGS. 2 to 5 are detents formed in the body 10 for engagement by a resilient member or resilient members on the bottom part of the jack, and by projections thereon, whereby the jack is assembled from a top and a bottom which are held together by interengagement of projections and recesses, detents and resilient members. Thus, as illustrated in FIG. 2, a recess 24 is formed in the forward ends of the outer parts of the lateral extensions 22. Also, a detent, or groove, 25 is formed in the top surface of the body 10, near the rear end of the part. As seen in FIG. 4, the forward edge or side of the recess 25 is substantially vertical while the rear edge or side is inclined. Finally, at the rear end of each lateral extension 22 is formed a detent or step 26. Th recesses 24 provides for holding down the front end of the part when assembled to a bottom part, while the detent 25 and the detents 26 provide alternative ways for retaining the top part in position.

Figure 6:
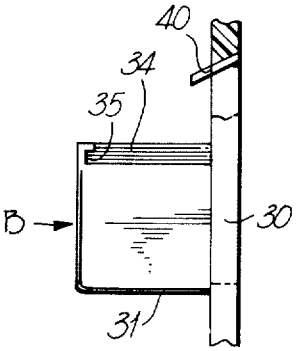
FIG. 6 is a side view of one form of another part of a jack for assembly with a part as in FIGS. 2 to 5.
Figure 8:
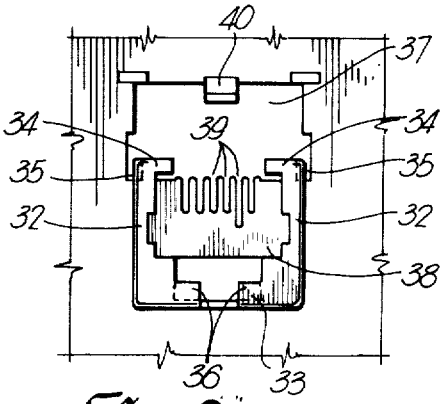
FIG. 8 is a front view in the direction of arrow B in FIG. 6.
Figure 7:
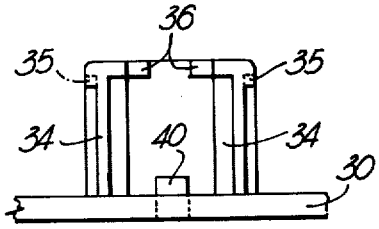
FIG. 7 is a top plan view of the part of FIG. 6.

The top part, with the retaining means, can be used with two different forms of bottom parts, for two different forms of jack. FIGS. 6 to 8 illustrates one form of bottom part which is basically a flat plate-like member 30 with a protruding member 31 which cooperates with a top part to form a profiled aperture for receiving a plug. As illustrated, the member 31 has two spaced walls 32 and a base 33 connecting walls. The top edges 34 of the walls are reduced in thickness for the major part of their length from the member 30, to form ribs, with an undercut 35 at the end. The walls 32 have a profiled cross-section to accept the plug profile and two locking projections 36 at the front end to engage with a latch on the plug. This arrangement is well known, for example as described in U.S. Pat. No. 3,850,497.

An aperture 37 extends through member 30 for passage of the top part therethrough. The member 30 forms a back wall 38 to the protruding member 31 and in the top edge of this wall 38 is formed a "comb", comprising a plurality of slots, and extending down from the top edge. The number of slots can vary and one, or more, of the slots may extend down further, as shown. At the top edge of the aperture 37 is a resilient tab 40.

Figure 9:
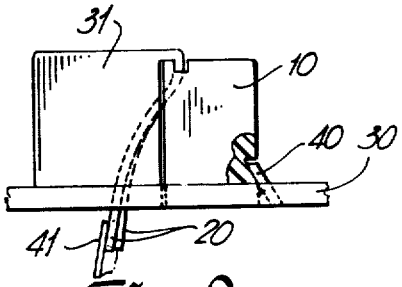
FIG. 9 is a side view of an assembled jack composed of the two parts illustrated in FIGS. 2 to 5 and 6 to 9.

FIG. 9 illustrates the assembly of a top part as in FIGS. 2 to 5 with a bottom part as in FIGS. 6, 7 and 8. The top part is inserted through the aperture 37 with the grooves 23 in the extensions 22 sliding on the reduced thickness top edges or ribs 34 of the walls 32. The top part is pushed forward until the recesses 24 cooperate with the undercuts 35, the lower part of the ends of the outer part of the lateral extensions, below the recesses 24, engaging in the undercuts 25. This locates and holds down the front end of the top part. As the top part is pushed through the aperture 37 the tab 40 is pushed up. When the top part is fully pushed in the end of the tab 40 drops into the detent or groove 25. This holds down the rear end of the top part and also prevents rearward movement of the top part. As the top part is pushed in the wire contact members 20 enter the slots 39 and are biased to a predetermined position. Conductors can be connected to the extreme, or free, ends of the wire contact members 20 and conveniently this can be done by a flexible circuit having contact areas which are soldered to the ends of the wire contact members. Such a circuit member is indicated at 41 in FIG. 9. The free ends of the contact members 20 can be splayed apart sideways to permit wider spacing of contact areas on the circuit member. Alternatively the free ends can be bent alternately up and down so as to be capable of being soldered on both sides of a circuit member. This also will give increased spacing.

Figure 10:
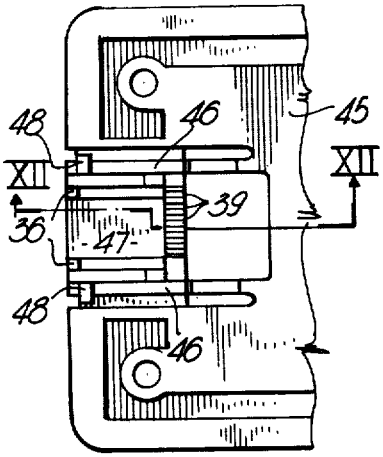
FIGS. 10 and 11 are top plan view and front view respectively of another form of the other part of a jack.
Figure 11:
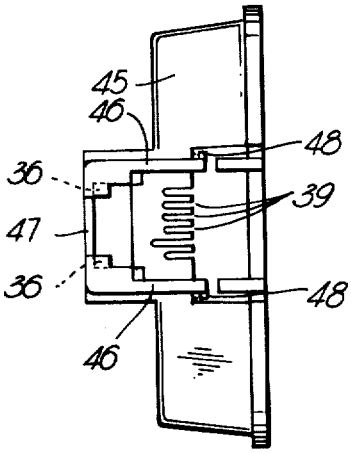
Figure 12:
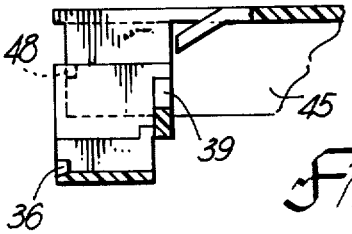
FIG. 12 is a cross-section on the line XII—XII of FIG. 10.
Figure 13:
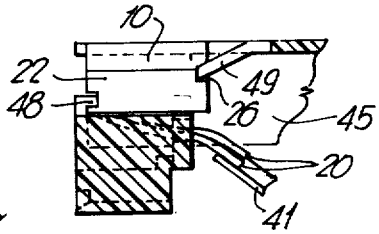
FIG. 13 is a cross-section on the same line as FIG. 12 but illustrating the assembly of the parts illustrated in FIGS. 2 to 5 and 10 to 12.

FIGS. 10, 11 and 12 illustrates an alternative form of bottom member. In this form the plug receiving aperture is formed at one end of a member 45. Side walls 46 and a base 47 define the bottom of the aperture. Projections 36 are provided for engagement with the plug latch as in the embodiment of 2, 3 and 4. At the forward ends of the top edges of the walls 46 are formed two outwardly extending projections 48. A rear wall 49 of the plug receiving aperture has a "comb" formed in its top edge, comprising slots 39 as in the embodiment of FIGS. 6, 7 and 8. The walls 46 and base 47 project below the main member 45. A top portion as in FIGS. 2 to 5 can be pushed in from the member 45, with the grooves 23 sliding on the top edges of the walls 46. The recesses 24 engage with the projections 48 to locate and hold down the front end of the top part. Extending down from the part 25 are two resilient members 49. The members 49 are deflected upward as the top part is pushed in, but drop down and engage in the detents or steps 26. This prevents the top part from moving rearward. This is illustrated in FIG. 13. As in the assembly illustrated in FIG. 9, the wire contact members 20 enter the slots 39 and are biased to a predetermined position. Conductors can be attached to the ends of the wire contact members, for example by means of a flexible circuit indicated at 41.

What is claimed is:

1. A modular telephone jack having two parts, a top part and a bottom part, said parts defining an aperture therebetween for reception of a modular plug, and a plurality of cantilever spring wire contact members extending from a front end of said top part downward and rearward into said aperture, said contact members being molded at a front end integrally with said top part of the jack.

2. A jack as claimed in claim 1, said bottom part including spaced apart side walls defining sides of said aperture, and end wall at a rear end of the bottom part, and extending between said side walls, and a plurality of slots extending in said end wall, said slots extending down from a top edge of said end wall, to form a comb, a contact member positioned in each slot, to provide a predetermined initial deflection of each contact member.

3. A jack as claimed in claim 2, said contact members plated with a corrosion resistant, low contact resistance material.

4. A jack as claimed in claim 3, the contact members plated only for that length contacted by contact members in a mating plug.

5. A jack as claimed in claim 1, said contact members roughened at the ends molded into the top part of the jack.

* * * * *